US007896715B2

(12) United States Patent
Kumakura et al.

(10) Patent No.: US 7,896,715 B2
(45) Date of Patent: Mar. 1, 2011

(54) CRIMPING TERMINAL HAVING A CONTACT PLATE STRIP

(75) Inventors: Hideto Kumakura, Shizuoka (JP); Naoki Ito, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/588,457

(22) Filed: Oct. 15, 2009

(65) Prior Publication Data

US 2010/0144217 A1 Jun. 10, 2010

(30) Foreign Application Priority Data

Dec. 10, 2008 (JP) ..... 2008-314001

(51) Int. Cl.
*H01R 4/10* (2006.01)

(52) U.S. Cl. ..... 439/877; 439/442

(58) Field of Classification Search ..... 439/877, 439/878, 879, 88, 882, 442, 421, 851; 174/84 C
See application file for complete search history.

(56) References Cited

U.S. PATENT DOCUMENTS 3,660,805 A * 5/1972 McDonough ..... 439/585
5,316,506 A 5/1994 Ito
6,953,365 B2 * 10/2005 Tabata et al. ..... 439/587
7,048,551 B2 * 5/2006 Takayama ..... 439/67
7,252,559 B1 * 8/2007 Morello et al. ..... 439/843
2004/0203286 A1 * 10/2004 Kameyama ..... 439/585
2005/0266727 A1 * 12/2005 Yamaguchi et al. ..... 439/585
2010/0105257 A1 * 4/2010 Kumakura et al. ..... 439/877

FOREIGN PATENT DOCUMENTS

JP 50-52490 5/1975
JP 62-147669 A 7/1987
JP 05-152011 A 6/1993
JP 2007-073491 A 3/2007

* cited by examiner

*Primary Examiner*—Hae Moon Hyeon
(74) *Attorney, Agent, or Firm*—Edwards Angell Palmer & Dodge LLP

(57) ABSTRACT

A crimping terminal includes a pair of core wire crimping pieces raised up from a bottom plate. A contact strip is provided with gaps formed between the core wire crimping pieces and the contact strip for inserting core wires of an aluminum electric wire. The contact strip has a sloped wall or a curved wall for guiding the core wires from the gaps toward the bottom plate. The contact strip is formed in a flat plate shape, and has sloped walls at both left and right sides thereof. The contact strip is formed in an arc sectional shape, and has curved walls at both left and right sides thereof. The contact strip is formed in an inverted V sectional shape, and has sloped walls at both left and right sides thereof. The contact strips are arranged two-tiered. A serration is formed on the contact strip.

8 Claims, 5 Drawing Sheets

CRIMPING TERMINAL HAVING A CONTACT PLATE STRIP

CROSS REFERENCE TO RELATED APPLICATIONS

This application is on the basis of Japanese Patent Application No. 2008-314001, the contents of which are hereby incorporated by reference.

BACKGROUND OF THE INVENTION

1. Field of the Invention

The present invention relates to a crimping terminal in which a contact plate is interposed in an inside of a pair of crimping pieces corresponding to aluminum electric wire or the like.

2. Description of the Related Art

FIG. 10 shows an embodiment of a conventional crimping terminal (See Patent Document 1).

A crimping terminal 61 respectively has a male tab at a tip end thereof (not shown) and a tubular electric wire crimping part 62 at a base end thereof. An aluminum electric wire (covered electric wire of which core wire is made of aluminum or aluminum alloy) 64 is crimped at the electric wire crimping part 62. Flange-shaped swaged parts 63 are projected from right and left sides of the crimping terminal 61.

FIG. 11 shows another embodiment of the conventional crimping terminal (See Patent Document 2).

A crimping terminal 65 is used for crimping a cable 66 which is a battery charger cable of a vehicle. The crimping terminal 65 includes a strip 68 raised from a bottom plate 67, and a crimping part 69. A covered electric wire 66 is inserted into the crimping part 69, and the strip 68 is inserted into core wires of the covered electric wire 66. Then, the crimping part 69 is crimped. Thus, it is unnecessary to strip the covered electric wire 66. An embodiment in which a pin instead of the strip 68 is inserted is described in Patent Document 3.

FIG. 12 shows the other embodiment of the conventional crimping terminal (See Patent Document 4).

A crimping terminal 70 includes a crimping part 71 and a level strip 72 disposed at middle in a height direction in the crimping part 71 and integrated with the crimping part 71. Serrations (a plurality of grooves) 73, 74 are formed on front and rear surfaces of the strip 72 and on an inner wall of the crimping part 71. Respective core wires of two covered electric wires (not shown) are inserted into parts above and below the strip 72, and crimped at the crimping part 71. Then, serrations 72, 73 cut into the core wires to remove oxide films of the core wires.

[Patent Document 1] Japanese Published Patent Application No. 2007-73491 (FIG. 4)

[Patent Document 2] Japanese Published Utility Model Application No. S50-52490 (FIG. 2)

[Patent Document 3] Japanese Published Patent Application No. S62-147669 (FIG. 1)

[Patent Document 4] Japanese Published Patent Application No. H05-152011 (FIG. 8)

However, in the conventional crimping terminal shown in FIG. 12, for example, when a single aluminum electric wire is crimped, it is difficult to separate the core wires equally into upper and lower sides of the strip 72, and there is a fear that a gap may be generated between the crimping part 71 and the core wires, or between the strip 72 and the core wires, thereby crimping connectivity may be reduced. The same is true in copper electric wire case instead of the aluminum electric wire. Recently, the demand for the aluminum electric wire has been increasing for weight saving of a wiring harness.

Accordingly, an object of the present invention is to provide a crimping terminal capable of increasing crimping connectivity by separating smoothly exposed core wires of electric wire into upper and lower sides of a strip which is interposed in a crimping part.

SUMMARY OF THE INVENTION

In order to attain the object, according to the present invention, there is provided a crimping terminal having a pair of core wire crimping pieces raised up from a bottom plate, wherein a contact strip is interposed between the pair of core wire crimping pieces via a gap for inserting core wires, and wherein the contact strip has a sloped wall or a curved wall for guiding the core wires from the gap toward the bottom plate.

According to the above structure, when the core wires are inserted into between the pair of core wire crimping pieces from above, respective core wires are guided downward along the sloped wall or the curved wall of the contact strip, and packed without any gap between the contact strip and the bottom plate. Thereby, when the electric wire is crimped (the pair of core wire crimping piece is crimped), a gap between the contact strip and the bottom plate is not generated, and the core wires closely contact the contact strip, the bottom plate, and the pair of core wire crimping pieces. Therefore, the core wires electrically contact with a wide contact area. The core wires of the electric wire can be inserted into between the pair of core wire crimping pieces not only from above, but also in a longitudinal direction of the crimping terminal.

When inserting the core wires, even if a gap is generated between the contact strip and the bottom plate, the core wires electrically closely contact the contact strip, the bottom plate, and the pair of core wire crimping pieces with a wide contact area by means of pressing downward the core wires at an upper side of the contact strip, and crimping the core wires while guiding the core wires along the sloped wall or the curved wall of the contact strip.

Preferably, the contact strip is formed in a flat shape, and has the sloped walls at both left and right sides thereof.

According to the above structure, the core wires smoothly fall down from gaps at both sides along the sloped walls at both left and right sides of the flat contact strip toward the bottom plate.

Preferably, the contact strip is formed in an arc sectional shape, and has the curved walls at both left and right sides thereof.

According to the above structure, the core wires smoothly fall down from gaps at both sides along the curved walls at both left and right sides of the arc sectional shaped contact strip toward the bottom plate. Preferably, the contact strip is composed of the curved walls at both left and right sides of the contact strip and an upper curved wall, however, the contact strip may be composed of an upper flat wall and the curved walls at both left and right sides of the flat wall.

Preferably, the contact strip is formed in an inverted V sectional shape, and has the sloped walls at both left and right sides thereof.

According to the above structure, the core wires smoothly fall down from gaps at both sides along the sloped walls at both left and right sides of the inverted V sectional shaped contact strip toward the bottom plate. Preferably, the contact strip has an inverted V sectional shape, however, the contact strip may have a trapezoidal shape.

Preferably, the contact strips are arranged two-tiered.

According to the above structure, two contact strips increase the contact area with the core wires, and in particular, when using a fat electric wire, or a plurality of electric wires, the crimped wires electrically closely contact the crimping terminal.

Preferably, a serration is formed on the contact strip.

According to the above structure, when crimping the electric wire, the serration of the contact strip, namely, a plurality of grooves and through holes with sharp edges contact the core wires, so that the oxide films of the core wires are removed, and the core wires further electrically closely contact the contact strip. Preferably, the serrations are formed on either upper and lower surfaces, or an upper surface of the contact strip.

These and other objects, features, and advantages of the present invention will become more apparent upon reading of the following detailed description along with the accompanied drawings.

DETAILED DESCRIPTION OF THE PREFERRED EMBODIMENTS

FIGS. 1 to 2 show an embodiment of a crimping terminal according to the present invention.

Figure 1A:
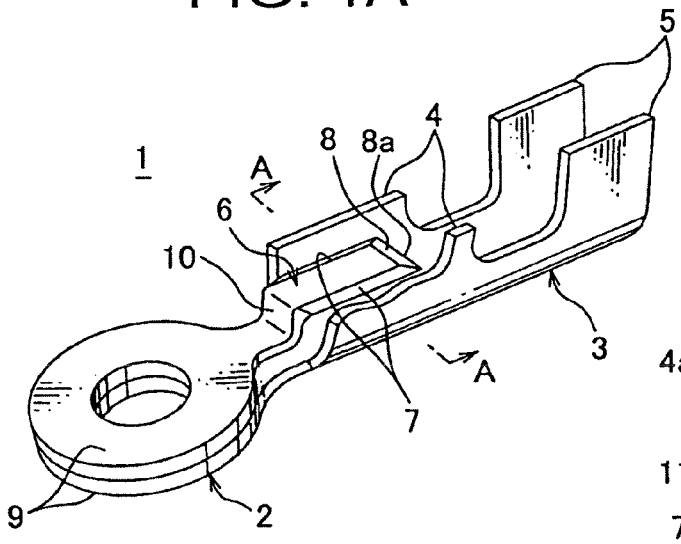
FIG. 1A is a perspective view showing an embodiment of a crimping terminal according to the present invention.

As shown in FIG. 1A, a crimping terminal 1 has a flat circular electric contact part 2 at a front half thereof, and an electric wire crimping part 3 at a rear half thereof. A contact strip 6 is integrally formed with the electric contact part 2, projected backward from the electric contact part 2, and interposed between a pair of core wire crimping pieces 4 disposed at a front side of the electric wire crimping part 3. Left and right sloped walls 7 are formed at left and right ends, and a rear sloped wall 8 is formed at a rear end, of the contact strip 6.

The electric contact part 2 is made of two circular plates 9 overlapped with each other. The circular plates 9 are connected to each other by welding or by a hinge (not shown) disposed at a front end or a side end of the circular plate 9. A step 10 is extended upward from a rear end of an upper circular plate 9. The contact strip 6 is horizontally projected backward from the step 10.

Figure 1B:
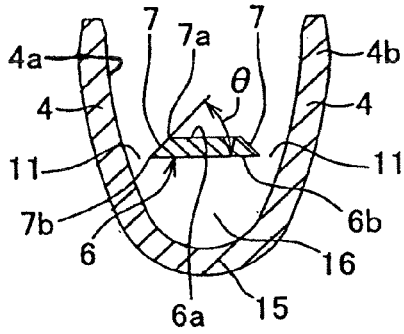
FIG. 1B is a sectional view taken on line A-A of FIG. 1A.

As shown in FIG. 1B, the contact strip 6 is interposed between the pair of core wire crimping pieces 4 at middle thereof in a height direction, and a gap 11 is generated between the contact strip 6 and an inner wall 4*a* of the core wire crimping piece 4. A slope angle θ of each of the left and right sloped walls 7 of the contact strip 6 is about 45 degree or less. An upper end 7*a* of each of the sloped walls 7 intersects with an upper wall 6*a* of the contact strip 6 with an obtuse angle, and a lower end 7*b* of each of the left and right sloped walls 7 intersects with a lower wall 6*b* of the contact strip 6 with an acute angle.

As shown in FIGS. 1A and 1B, a slope angle of the sloped wall 8 at the rear end of the contact strip 6 is substantially the same as the sloped angle of the sloped walls 7. When an aluminum electric wire 12 (FIG. 2) is inserted horizontally into the electric wire crimping part 3, the sloped wall 8 smoothly and surely separates the core wires 13 of the aluminum electric wire 12 into upper and lower sides.

When the aluminum electric wire 12 is inserted downward from above into the electric wire crimping part 3, the left and right sloped walls 7 smoothly separates core wires 13 into left and right sides, and allows the core wires to smoothly and surely fall down toward the lower side of the contact strip 6, namely, toward a gap 16 generated between a curved bottom plate 15 of the electric wire crimping part 3 and the horizontal contact strip 6.

A pair of covered wire crimping pieces 5 is arranged higher than the core wire crimping pieces 4 at a rear side of the core wire crimping pieces 4. A rear end 8*a* of the contact strip 6 is arranged a little forward of a rear end of the core wire crimping pieces 4. The contact strip 6 is interposed between the core wire crimping pieces 4. The gaps 11 are respectively generated between left and right lower ends 7*b* of the contact strip 6 and the inner wall 4*a* of the core wire crimping pieces 4 for separating the core wires 13 of the aluminum electric wire 12, and allowing the core wires to fall down. FIG. 1A shows one of the core wire crimping pieces 4 which is partially cut.

Figure 2A:
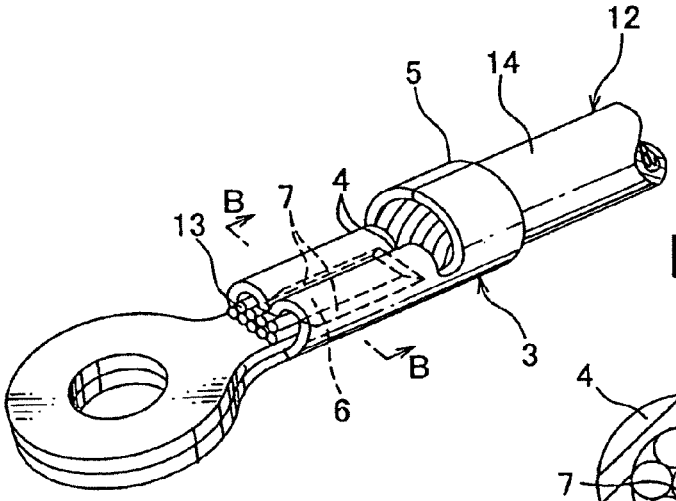
FIG. 2A is a perspective view showing a crimped electric wire with the crimping terminal.
Figure 2B:
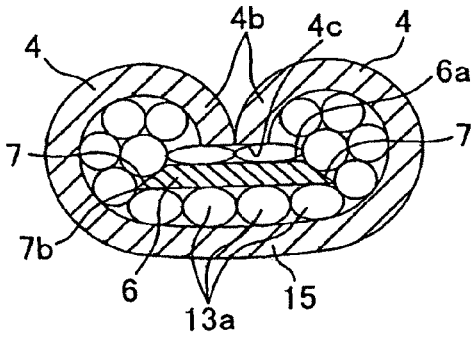
FIG. 2B is a sectional view taken on line B-B of FIG. 2A.

As shown in FIGS. 2A and 2B, when the aluminum electric wire 12 is crimped at the electric wire crimping part 3, simultaneously, each core wire 13*a* is packed without a gap at the lower side of the contact strip 6, namely, between the contact strip 6 and the bottom plate 15. While upper ends 4*b* of the core wire crimping pieces 4 are curved inward in glasses shape, the core wires 13 pressed downward by the core wire crimping pieces 4 are smoothly inserted into the lower side of the contact strip 6 along the left and right sloped walls 7 of the contact strip 6, and crimped firmly between the bottom plate 15 and the contact strip 6. The core wires 13 on the upper wall 6*a* of the contact strip 6 are crimped between tip ends 4*c* of the core wire crimping pieces 4 and the contact strip 6.

Thus, the core wires 13 contact the electric wire crimping part 3 with a large contact area. Because each of the left and right lower ends 7*b* of the left and right sloped walls 7, and the rear end 8*a* of the rear sloped wall 8 is in a sharp edge shape, when the core wires 13 strongly contact (slidingly contact) the left and right lower ends 7*b* and the rear end 8*a*, the oxide films of the core wires 13 are removed, and the core wires 13 surely electrically contact the crimping terminal 1.

In a case that a fat electric wire of which core wire having a large diameter is crimped, or two electric wires are crimped, a ratio of a sectional area of the core wires 13 to a contact area between the core wires 13 and the core wire crimping pieces 4 is relatively large, further, the core wires 13 relatively slide little on each other. Therefore, contact reliability between the core wires 13 and the core wire crimping pieces 4 is reduced. However, because the contact area with the core wires 13 is increased by means of the contact strip 6, the contact reliability is increased.

The aluminum electric wire 12 is crimped between an upper crimper and a lower anvil using a crimping machine (not shown). The crimper has a terminal pressing wall in a substantially heart shape, and the anvil has an arc-shaped terminal receiving wall. The crimping machine may be operated automatically or manually. A handy type nipper-shaped crimping machine can also be used.

FIGS. 3A to 6 show the other embodiments of the crimping terminal. Components including the same functions as those in FIGS. 1A to 2B are given the same reference numbers, and detailed explanation is omitted.

While the contact strip 6 of FIG. 1 is flat, a contact strip 22 of a crimping terminal 21 is curved in an arc sectional shape (upward concave). The core wires 13 of the aluminum electric wire 12 (See FIG. 2A) at the upper side of the contact strip 22 smoothly fall down along an upper curved wall 22*a* of the contact strip 22, and are separated into upper and lower sides.

Figure 3A:
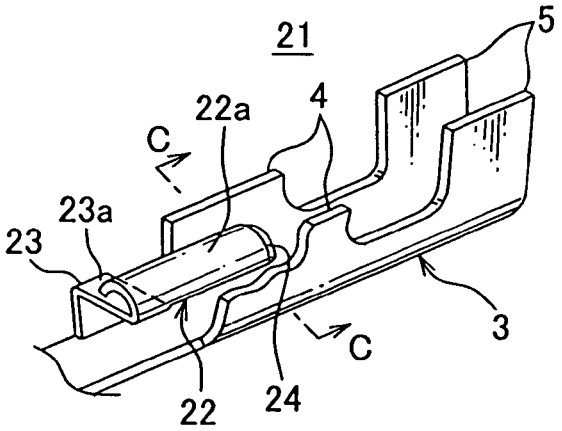
FIG. 3A is a perspective view partially showing another embodiment of the crimping terminal according to the present invention.

The contact strip 22 may be projected backward from the electric contact part 2 like the embodiment shown in FIG. 1. In FIG. 3A, a support wall 23 is extended vertically in an L shape from the bottom plate 15, which is lower than the core wire crimping pieces 4. Then, the contact strip 22 is folded upward from a horizontal plate 23*a* of the support wall 23, extended backward from the support wall 23, and interposed between the pair of core wire crimping pieces 4.

Figure 3B:
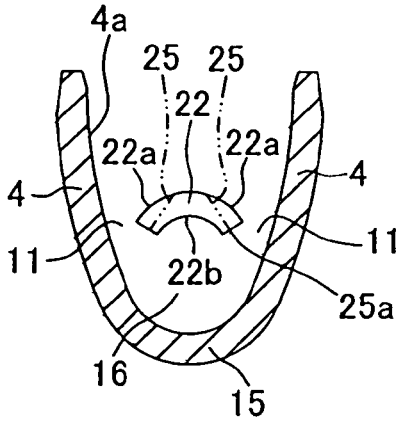
FIG. 3B is a sectional view taken on line C-C of FIG. 3A.

Preferably, a sloped wall 24 is formed at a rear end of the contact strip 22 like the embodiment shown in FIG. 1. As shown in FIG. 3B, gaps 11 for allowing the core wires 13 of the aluminum electric wire 12 (FIG. 2) to smoothly fall down are formed between the left and right ends of the contact strip 22 and the inner wall 4*a* of the pair of core wire crimping pieces 4.

The core wires 13 are separated into left and right sides along the left and right upper curved walls 22*a*, smoothly and equally fall down, and are interposed between the contact strip 22 and the bottom plate 15 (gap 16). Like the embodiment shown in FIG. 2B, when crimping the aluminum electric wire 12, the core wires 13 positioned at a top of the contact strip 22 is pressed downward along the upper curved wall 22*a* of the contact strip 22, and packed without a gap in between the lower curved wall 22*b* and the bottom plate 15.

In FIG. 3B, if a curvature radius of the contact strip 22 is large, sloped walls 25 may be formed at left and right side of the curved contact strip 22 like the embodiment shown in FIG. 1. The tip end 25*a* of the sloped wall 25 wall 25 is an edge for biting the core wires 13 and removing the oxide films from the surfaces of the core wires 13.

In FIG. 3A, reference number 24 denotes a sloped wall at the rear end, and reference number 5 denotes a covered wire crimping piece. Like the embodiment shown in FIG. 1, the shape of the electric contact part 2 is not limited to a circular plate, and may be tabular shape, or a male type (box shape, or tubular shape).

Figure 4:
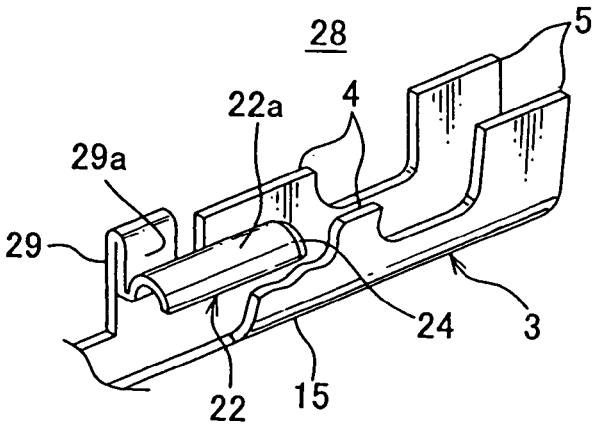
FIG. 4 is a perspective view partially showing the other embodiment of the crimping terminal according to the present invention.

A crimping terminal 28 in FIG. 4 is an example of changing the shape of the crimping terminal 21 of FIG. 3. A support wall 29 is extended vertically from the bottom plate 15 as high as the core wire crimping pieces 4. A folded part 29*a* is folded downward from the support wall 29. A contact strip 22 having an arc sectional shape is extended from a bottom end of the folded part 29*a*. Because no interfering object exists at a bottom side of the contact strip 22, when crimping the aluminum electric wire 12, the contact strip 22 is moved freely in the electric wire crimping part 3 to speed up the packing of the core wires 13 (FIG. 2) in the bottom side of the contact strip 22. Components including the same functions as those in FIG. 3 are given the same reference numbers in FIG. 4, and detailed explanation is omitted.

Figure 5:
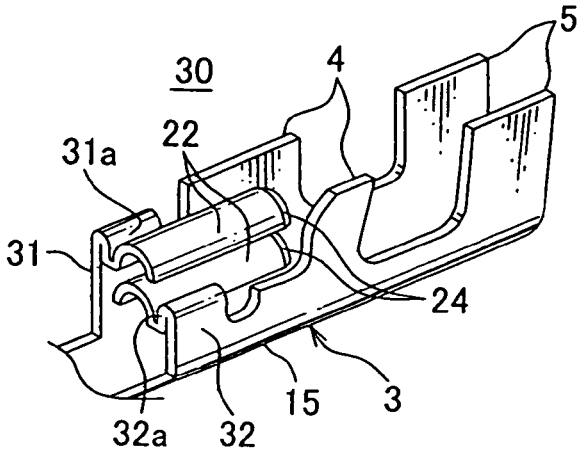
FIG. 5 is a perspective view partially showing the other embodiment of the crimping terminal according to the present invention.

A crimping terminal 30 in FIG. 5 is an example of changing the shape of the crimping terminal 28 of FIG. 4. In the crimping terminal 30, two contact strips 22 each having the arc sectional shape are disposed up and down and parallel to each other inside the electric wire crimping part 3. A higher supporting wall 31 is formed at one side of the bottom plate 15, and a lower supporting wall 32 is formed at the other side of the bottom plate 15. The contact strip 22 is projected from each folded part 31*a*, 32*a* extending from each supporting wall 31, 32. Components including the same functions as those in FIG. 4 are given the same reference numbers in FIG. 5, and detailed explanation is omitted.

The contact area with respect to the core wires 13 of the aluminum electric wire 12 (FIG. 2) is increased by means of the upper and lower contact strips 22. Incidentally, the flat contact strip 6 according to the embodiment of FIG. 1 may be disposed up and down similar to the embodiment of FIG. 5.

Figure 6:
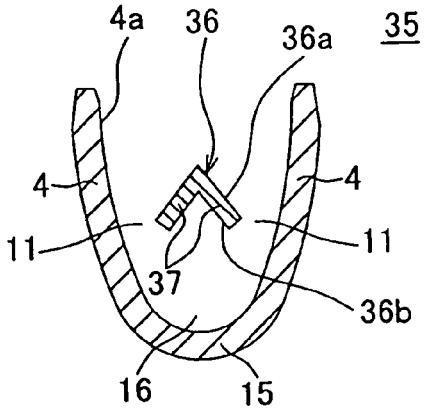
FIG. 6 is a sectional view showing the other embodiment of the crimping terminal according to the present invention.

In a crimping terminal 35 of FIG. 6, a shape of a contact strip 36 is neither flat nor arc sectional, but inverted V sectional. The contact strip 36 is composed of a pair of sloped plates 37. Each sloped plate 37 includes upper and lower sloped walls 36*a*, 36*b*.

Gaps 11 are formed between the left and right ends of the contact strip 36 and an inner wall 4*a* of the core wire crimping pieces 4 for allowing the core wires 13 (FIG. 2) to smoothly fall down along the inverted V sectional shaped contact strip 36. A slope angle of the inverted V sectional shaped contact strip 36 can be sharper than that of the arc sectional shaped contact strip 22 (FIG. 3). Thus, the gaps 11 at both left and right sides become wider. If the sectional area of the contact strip 36 is the same as the contact strip 22 (FIG. 3), the contact area of the core wires 13 with respect to the contact strip 36 is greater than that with respect to the contact strip 22.

Similar to the embodiments of FIGS. 1 to 5, when crimping the crimping terminal 35, the core wires 13 disposed at the upper side of the contact strip 36 are pressed downward along the upper sloped wall 36*a* of the contact strip 36, and packed between the lower sloped wall 36*b* of the contact strip 36 and the bottom plate 15 (a space 16) without a gap.

Incidentally, in FIG. 6, the shape of the contact strip 36 may be trapezoidal (a horizontal flat plate with sloped plates 37) instead of inverted V sectional. Further, similar to the embodiment of FIG. 5, two contact strips 36 may be disposed up and down.

Figure 7A:
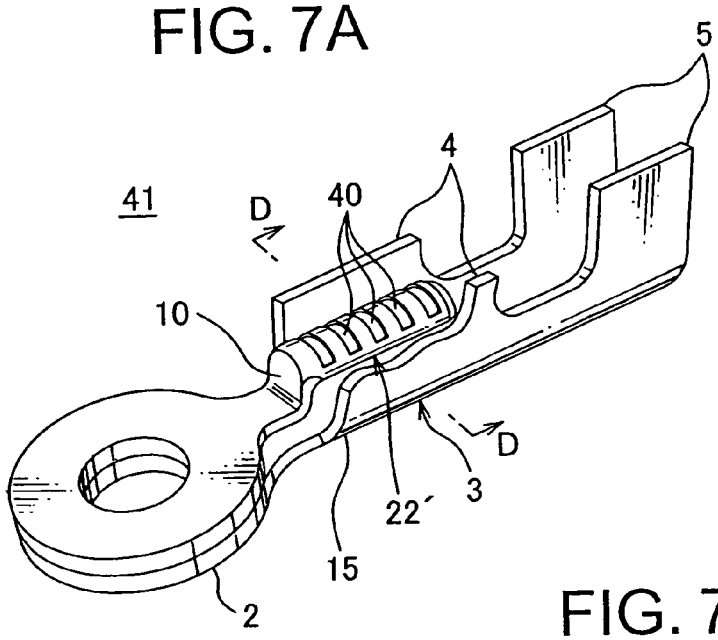
FIG. 7A is a perspective view showing the other embodiment of the crimping terminal according to the present invention.
Figure 7B:
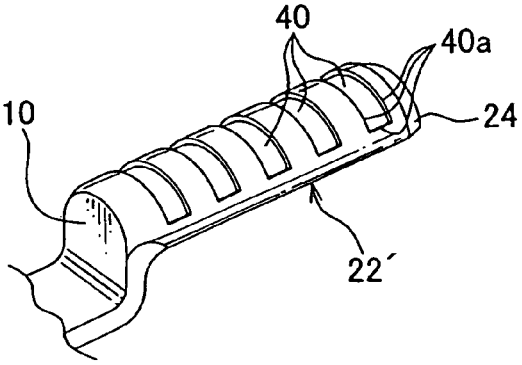
FIG. 7B is an enlarged perspective view partially showing the crimping terminal of FIG. 7A.
Figure 7C:
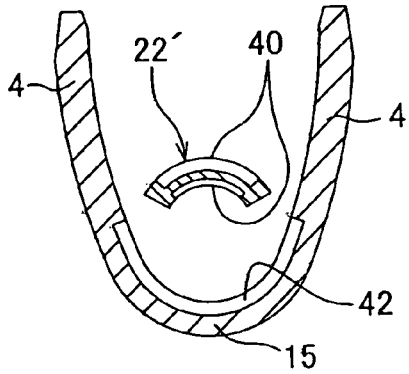
FIG. 7C is a sectional view taken on line D-D of FIG. 7A.
Figure 8:
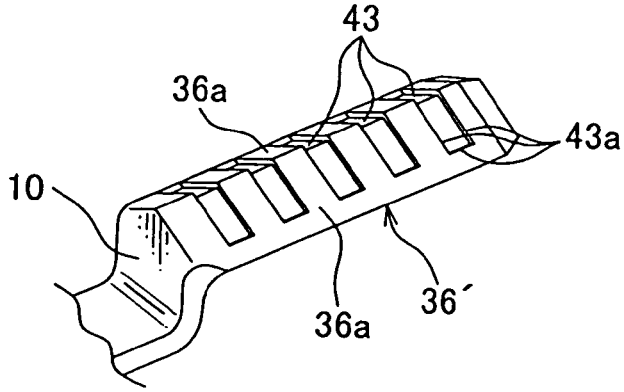
FIG. 8 is an enlarged perspective view partially showing the other embodiment of the crimping terminal according to the present invention.
Figure 9:
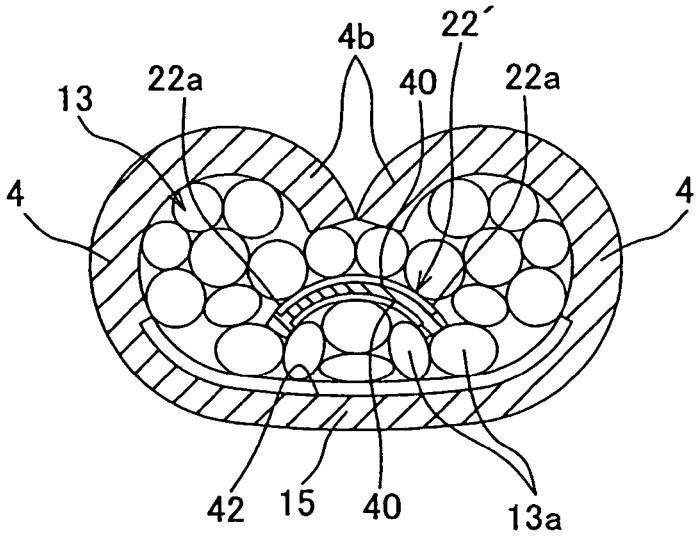
FIG. 9 is a sectional view showing the crimped electric wire with the crimping terminal according to the present invention.
Figure 10:
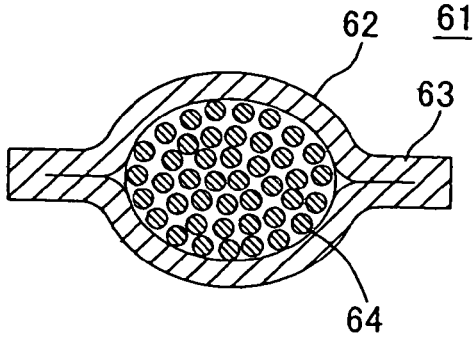
FIG. 10 PRIOR ART
FIG. 10 is a sectional view showing an embodiment of a conventional crimping terminal.
Figure 11:
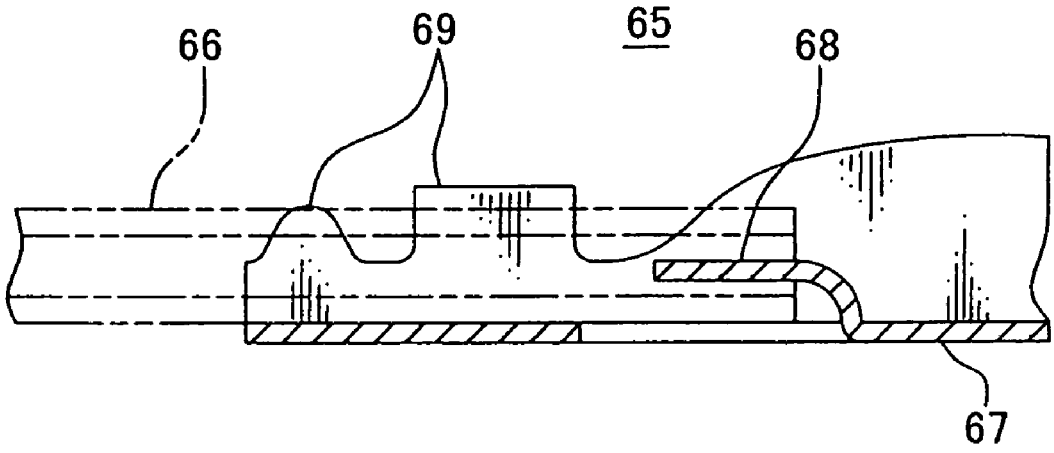
FIG. 11 PRIOR ART
FIG. 11 is a lateral sectional view showing another embodiment of the conventional crimping terminal.
Figure 12:
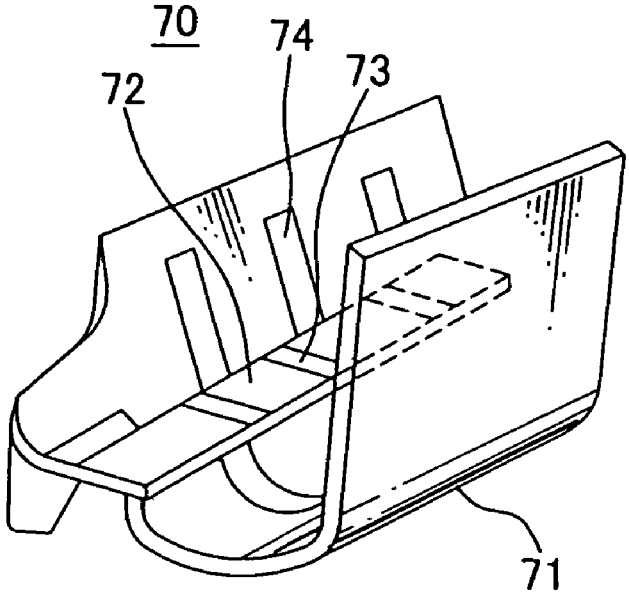
FIG. 12 PRIOR ART
FIG. 12 is a perspective view showing the other embodiment of the conventional crimping terminal.

FIGS. 7 to 9 show embodiments in which a serration (a plurality of grooves) is formed on both upper and lower walls of the contact strips 22, 26 of the crimping terminals 21, 35. Figures showing embodiments of the serration formed on the flat contact strip 6 of FIG. 1, and of the serration formed on the two contact strips 22 of FIG. 5 are omitted.

In a crimping terminal 41 shown in FIGS. 7A to 7C, serrations 40 are formed on both front and rear sides of the arc sectional shaped contact strip 22'. Grooves 40 are arranged in a width (transverse) direction of the contact strip 22'. Preferably, the serrations on the front and rear sides are arranged alternately.

The groove 40 at the rear side (FIG. 7C) may be omitted. A long hole (not shown) may be used instead of the groove 40 in the serration. In any case, each end of the groove (hole) 40 has a sharp edge 40*a*. When crimping, the edge 40*a* removes the oxide film from the core wires 13 of the aluminum electric wire 12 (FIG. 2) while the edge 40 slidingly contacts the core wires 13.

An embodiment shown in FIG. 1A corresponds to the embodiment of FIG. 1. The contact strip 22' is projected via a step 10 from the circular electric contact part 2. The shape of the contact strip 22' may be any one of those of FIGS. 3A to 5. As shown in FIG. 7C, the serration 42 is formed on the bottom plate 15 of the electric wire crimping part 3 facing the contact strip 22'.

As shown in FIG. 8, a serration 43 may be formed on both front and rear sides of the inverted V sectional shaped contact strip 36 of FIG. 6 instead of the arc sectional shaped contact strip 22'. Similar to the contact strip 22' of FIG. 7, the contact strip 36' of FIG. 8 is projected via the step 10 from the circular electric contact part 2 (FIG. 7).

As shown in FIG. 9, when crimping, top ends 4*b* of the core wire crimping pieces 4 bend inward and press the core wires 13 downward, and the core wires 13 are moved downward along the curved walls 22*a* of the contact strip 22' or the sloped walls 36*a* of the contact strip 36' (FIG. 8) and packed between the bottom plate 15 and the contact strip 22' or 36'. At the same time, edges 40*a*, 43*a* of the serration 40, 43 of the contact strip 22', 36' remove the oxide films of the core wires 13, and the electrical contact between the core wires 13 and the contact strip 22' 36' is improved. Similarly, the serration 42 of the bottom plate 15 removes the oxide films of the core wires 13 disposed along the bottom plate 15.

Incidentally, in the above embodiments, the aluminum electric wire 12 is used. However, even when using a copper electric wire instead of the aluminum electric wire 12, the electrical contact can be improved because the contact area of the core wires 13 is increased owing to the contact strip 6, 22, 36.

Further, a crimping terminal of this invention may include at least the pair of core wire crimping pieces 4 (for example, a joint terminal), therefore, the electric contact part 2 and the covered wire crimping pieces 5 are not necessary according to the present invention.

Further, the configurations of the above embodiments can be used in an electric wire crimping structure of the crimping terminal, a method for crimping an electric wire, and a method for setting an electric wire other than the crimping terminal.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A crimping terminal comprising:

a pair of core wire crimping pieces raised up from a bottom plate;

an electric contact part extending from the bottom plate; and at least one contact strip is interposed between the pair of core wire crimping pieces via a gap for inserting core wires of an electric wire, wherein the contact strip has a sloped wall or a curved wall for guiding the core wires from the gap toward the bottom plate, wherein the contact strip is integrally formed with the electric contact part or the core wire crimping pieces, and wherein the contact strip is projected in a direction from the electric contact part toward the electric wire, the contact strip extending from a step portion which extends upward from the electric contact part.

2. The crimping terminal as claimed in claim 1, wherein the contact strip is formed in a flat shape, and has the sloped walls at both left and right sides thereof.

3. The crimping terminal as claimed in claim 1, wherein the contact strip is formed in an arc sectional shape, and has the curved walls at both left and right sides thereof.

4. The crimping terminal as claimed in claim 1, wherein the contact strip is formed in an inverted V sectional shape, and has the sloped walls at both left and right sides thereof.

5. The crimping terminal as claimed in claim 1, further comprising a plurality of contact strips, wherein the contact strips are arranged one above the other.

6. The crimping terminal as claimed in claim 1, wherein a serration is formed on the contact strip.

7. The crimping terminal as claimed in claim 1, wherein the gap is arranged between a side of the at least one contact strip and one of the pair of core wire crimping pieces.

8. The crimping terminal as claimed in claim 1, wherein the electric contact part comprises two circular plates overlapped with each other, and the step portion extends upward from a rear end of an upper one of the two circular plates.

* * * * *